US005839920A

United States Patent [19]

Yurko et al.

[11] Patent Number: 5,839,920

[45] Date of Patent: Nov. 24, 1998

[54] ELECTRICAL CONNECTOR SEAL

[75] Inventors: Garold Michael Yurko, Greensboro; John Rudell Bussard; Mark Dwayne Andersen, both of Kernersville, all of N.C.

[73] Assignee: The Whitaker Corporation, Wilmington, Del.

[21] Appl. No.: 569,407

[22] Filed: Dec. 6, 1995

[51] Int. Cl.[6] ..... H01R 13/40

[52] U.S. Cl. ..... 439/587

[58] Field of Search ..... 439/587, 589, 439/274, 275, 279, 271; 174/65 G, 65 R, 151, 153 G, 152 G; 277/208, 209, 215

[56] References Cited

U.S. PATENT DOCUMENTS

| | | | |
|---|---|---|---|
| 4,424,406 | 1/1984 | Slater et al. | 174/65 R |
| 4,959,022 | 9/1990 | Neuroth | 439/589 |
| 4,961,713 | 10/1990 | McCracken et al. | 439/587 |
| 5,100,335 | 3/1992 | Yamamoto | 439/271 |
| 5,145,410 | 9/1992 | Maejima et al. | 439/587 |
| 5,213,290 | 5/1993 | Moretti | 248/56 |
| 5,214,247 | 5/1993 | Tamm | 174/65 R |
| 5,538,441 | 7/1996 | Paolucci et al. | 439/587 |

*Primary Examiner*—Neil Abrams
*Assistant Examiner*—Christopher Goins
*Attorney, Agent, or Firm*—Bradley N. Ditty

[57] ABSTRACT

A seal (10) for use with an electrical connector includes an array of sealing units (20) each including a funnel-shaped section (22), an annular recess (24), an annular projection (26), and a box shaped recess (28). Adjacent to the sealing units are respective relaxation cores (30) for allowing the seal material to flow and fill in the relaxation cores thereby relieving the sealing units of stress and preventing tearing or cutting of the seal as the electrical contact (40) is inserted through the sealing unit (20). An interface angle (22*c*) is advantageously formed in a steep fashion so that the corners of the electrical contact (40) do not cut or tear the seal material. The funnel-shaped section (22) includes a sealing rib (22*d*) which is forced by insertion of the contact to flow towards an annular recess (24), and an annular projection (26) is forced to flow toward the box shaped recess (28), thereby further relieving the sealing unit (20) of stresses and preventing cutting or tearing of the seal material as the contact (40) is inserted through the sealing unit.

24 Claims, 2 Drawing Sheets

ELECTRICAL CONNECTOR SEAL

The present invention relates to seals for use with electrical connectors; more particularly, the present invention relates to an electrical connector seal for receiving box shaped contacts therethrough without tearing the seal, and which provides a good sealing interface between the insulation of a conductor terminated to the electrical contact and the seal.

BACKGROUND OF THE INVENTION

Known electrical connector seals which are commonly available include apertures for receiving electrical contacts therethrough. The apertures generally include a frustoconical section for having a lead-in angle which accommodates the front end portion of the electrical contact as it is inserted through the seal. The function of the lead-in angle is to prevent tearing of the seal as the sharp edges and/or corners of the electrical contact are forced through the seal. However, when a plurality of electrical contacts are forced through a seal in a high density application, the seal material, being flexible and behaving somewhat as an incompressible fluid, has little room to flow, so that stress concentrations will be induced in the seal. Tension and compression concentration loci will be created in the seal, so that certain portions of the seal may fracture and tear when forced into engagement with the sharp edges of the electrical contact as it passes through the seal. Thus, as the electrical contact is forced through the seal, the seal material must flow to an area whereby the electrical contact can pass through the seal without fracturing or tearing the seal.

In light of the forgoing, what is needed is an electrical contact seal for high density applications which: will not tear or fracture when an electrical contact is inserted therethrough; includes a seal configuration which advantageously allows the seal material to flow in directions that tend relieve the stresses as the electrical contact is forced therethrough; and is of a compact design, is easy to manufacture, and is of a low cost.

SUMMARY OF THE INVENTION

The present invention provides a seal for use with an electrical terminal comprising at least one sealing unit, the sealing unit includes a contact receiving aperture comprising a front section, the front section comprises face surfaces which are offset at respective offset angles relative to the contact receiving aperture, a portion of the face surfaces are adjacent to a recess zone, the recess zone is offset at an angle relative to the contact receiving aperture, and the recess zone offset angle is relatively larger than the offset angle of at least one of the face surfaces. The front section of the sealing unit comprises a generally funnel-shaped portion disposed about the contact insertion aperture for providing a lead-in area for the contact. The contact receiving aperture comprises an annular recess disposed between a rib and a projection, each respectively formed of the seal, for sealing engagement with a conductor terminated to the contact, and the seal comprises at least one relaxation core adjacent to the sealing unit. The relaxation core comprises an essentially void space of a given volumetric magnitude, and the void space becomes relatively smaller as the contact is inserted through the sealing unit, thereby relieving stress in the seal. Additionally, the recess zone comprises a stress-relieving shape which is centered over the contact aperture, and, in a preferred embodiment, the recess zone is generally X-shaped.

DETAILED DESCRIPTION OF THE INVENTION

Figure 1:
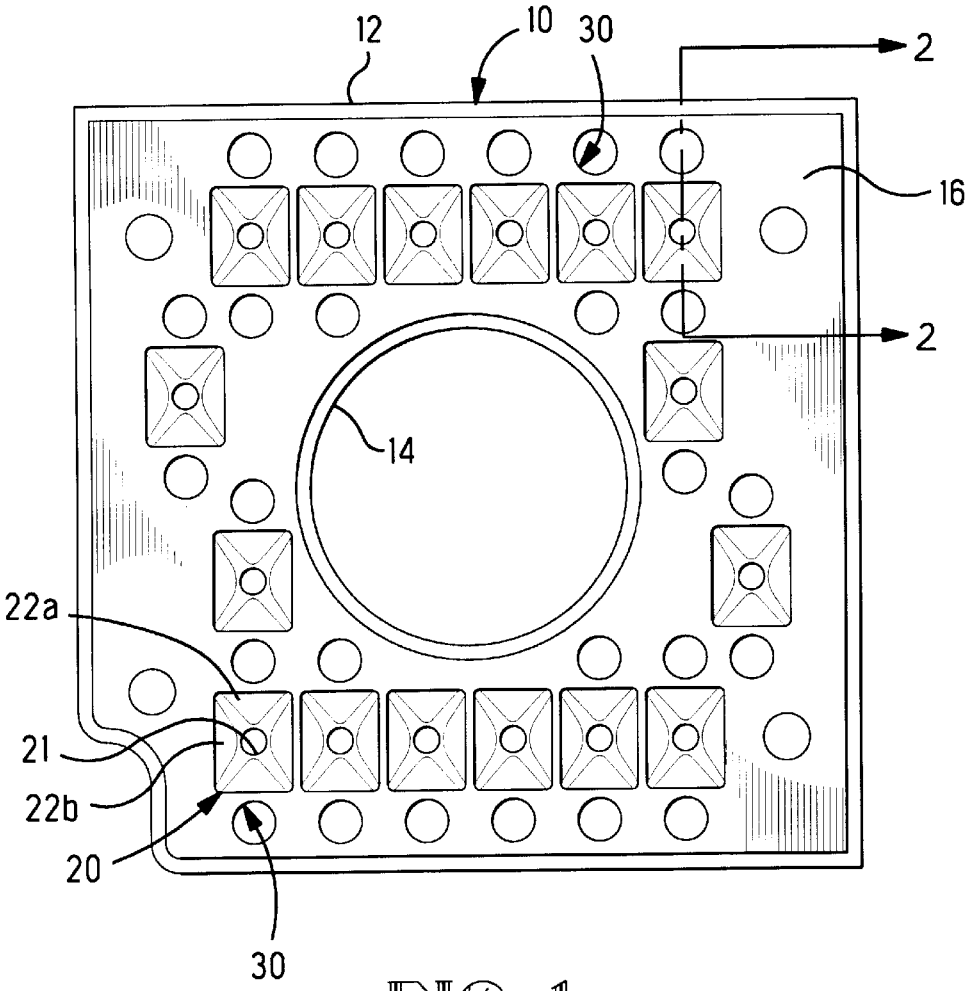
FIG. 1 shows an elevational view of a front side of the electrical connector seal of the present invention.
Figure 2:
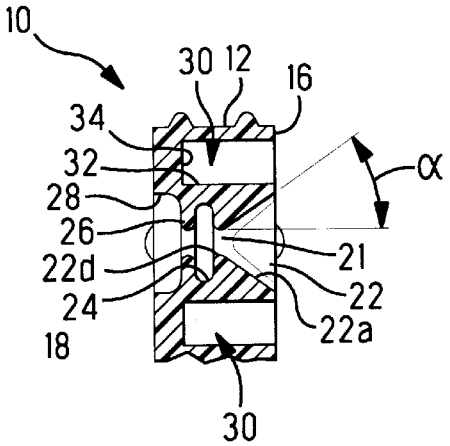
FIG. 2 shows a cross sectional view of a portion of the seal of FIG. 1 taken along line 2—2 of FIG. 1.

Referring to FIGS. 1 and 2, the electrical connector seal 10 according to the present invention will be described. Seal 10 includes a sealing outer periphery 12 for engagement with a sealing wall of an electrical connector, a sealing inner periphery 14 for engagement with a sealing wall of an electrical connector, a front face 16, and a back face 18. The front face 16 includes sealing units 20, and relaxation cores 30 adjacent thereto.

Figure 3:
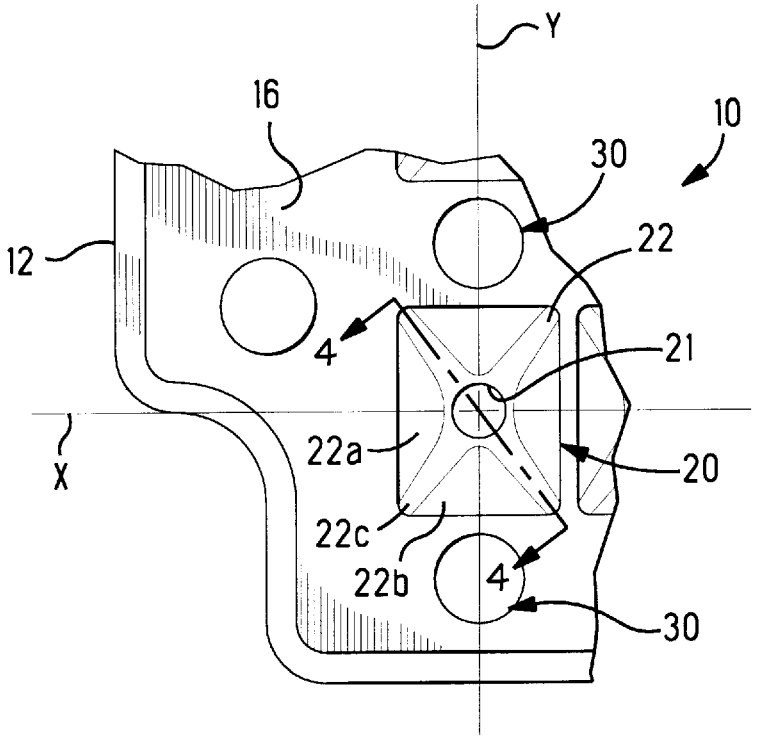
FIG. 3 shows a portion of the front seal of FIG. 1.

Each sealing unit 20 includes a contact receiving aperture 21, a generally funnel-shaped section 22, an annular recess 24, an annular projection sealing profile 26, and a box shaped recess 28 extending from back face 18. Each generally funnel-shaped section 22 includes a pair of curved faces 22*a* and 22*b* with an recess zone 22*c* between them as shown in FIG. 3. Each face 22*a* and 22*b* comprises a respective contour, in a bulge-like relief relative to the recess zone 22*c*, which represents a boundary between the respective face and the recess zone 22*c*. The boundaries of respective faces 22*a*,22*b* comprise generally straight, sloping lines capped by an arcuate edge adjacent to aperture 21. The recess zone 22*c* is generally X-shaped and is centered over aperture 21, and the leg sections of the recess zone 22*c* which extend to the outer periphery of the sealing unit 20 are recessed relative to the face portions 22*a* and 22*b*. The innermost periphery of section 22 includes a sealing profile rib 22*d* for slidingly engaging an electrical contact 40, before the contact has been fully inserted in the seal, as shown in FIG. 5.

As noted above, relaxation cores 30 are located adjacent to respective sealing units 20. Each relaxation core includes an annular wall 32, and a bottom wall 34, and is preferably of a cylindrical shape, although other shapes may be used. As shown in FIG. 1, the relaxation cores 30 are disposed adjacent to sealing units 20 on a generally two-to-one basis. However, some sealing units 20 which are located adjacent to inner periphery sealing surface 14 would not require a relaxation core 30 because the sealant material will flow by virtue of the inner periphery 14 being adjacent to the sealing unit 20.

Figure 4:
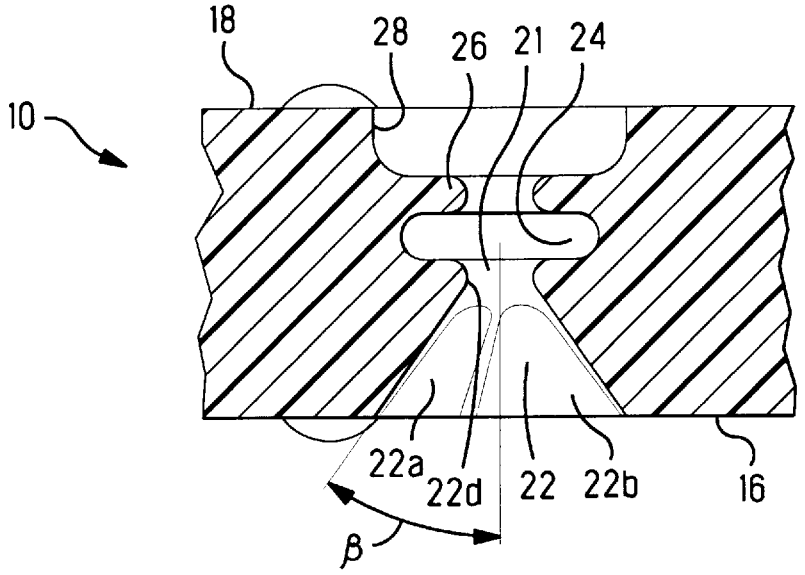
FIG. 4 shows a cross sectional view of a portion of the seal of FIG. 3 taken along line 4—4.

Now referring to FIGS. 3 and 4, the seal 10 will be further described. FIG. 3 shows the interface 22*c* which extends between faces 22*a* and 22*b* of sealing unit 20. Referring to FIG. 2, angle $\alpha$ depicts a lead-in angle for sliding engagement with an electrical contact to be inserted into contact receiving aperture 21. Angle $\alpha$ is found generally at the intersection of lines X and Y with faces 22*a*,22*b*, respectively, as shown in FIG. 3. Referring now to FIG. 4, angle $\beta$ depicts an angle of the surface of recess zone 22*c*, between faces 22*a* and 22*b* of sealing unit 20, and represents the recess zone corners, i.e. between faces 22*a* and 22*b*, as shown in FIG. 3. In a preferred embodiment of the invention, the lead-in angle $\alpha$ is about 35° ±10° or less depending on the thickness of the seal 10, measured from the contact insertion axis; and the interface angle β of recess zone 22*c* is about 40° ±10° or less depending on the thickness of the seal, as measured from the contact insertion axis. Therefore, there is a gradual increase in steepness, along the curved surfaces of faces 22*a* and 22*b*, from the 35° lead-in angle α to the 40° interface angle β, which advantageously allows the corners of the sealing units 20 to slidingly deform around, for example, the sharp corners of a box contact without tearing or fracturing of the seal material. Additionally, the angles α and β are calculated to minimize the amount of required seal thickness, between the front and back faces 16,18, so that the seal 10 is a compact design which prevents fracturing or cutting of the seal material as the box contact 40 is inserted therethrough.

Figure 5:
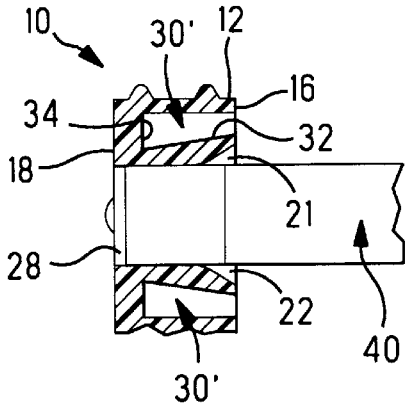
FIG. 5 shows the cross section of FIG. 2 with an electrical contact being inserted through the seal.

Referring now to FIG. 5, the behavior of the seal 10 as an electrical contact 40 is inserted therethrough will now be described. FIG. 5 shows an electrical contact 40 being inserted through contact receiving aperture 21. The contact 40 is, for example, a box shaped receptacle contact. FIG. 5 is shown adjacent to FIG. 2 in the appended drawings for ready comparison between the two. Relaxation cores 30 are shown to have a different shape 30' in FIG. 5, which represents a narrower, or smaller volumetric space, as compared to the relaxation core 30 of FIG. 2. This is due to the fact that rib 22*d* will be in engagement with the outer surface of electrical contact 40 and the seal material will flow away from contact 40 as the contact is inserted into contact receiving aperture 21 thereby making the volumetric space of relaxation core 30' relatively smaller. Additionally, annular projection 26 is in engagement with the box contact 40 further outwardly moving the seal material away from contact 40. Furthermore, the annular projection 26 and rib 22*d* are allowed to flow toward backface 18 by virtue of: annular recess 24, which provides a space for rib 22*d* to flow; and the box shaped recess 28, which provides a space for annular projection 26 to flow.

However, it is important to note that the funnel-shaped section 22 initially engaged the box contact 40 and the corners of the box contact 40 did not tear the seal material because of the lead-in angle α, and the steepness associated with interface angle β, which cooperate to relieve stress in the area of the box contact's sharp outer corners. Additionally, FIG. 5 shows two relaxation cores 30 or 30' associated with a respective sealing unit 20, but some sealing units 20 are disposed adjacent to sealing inner periphery 14, and the seal material can therefore flow towards sealing inner periphery 14, thereby obviating the need for a second relaxation core 30 for that particular sealing unit 20.

After the electrical contact 40 has been fully inserted through the sealing unit 20, the annular projection 26 and rib 22*d* will relax, and relaxation cores 30' will revert to a volumetric space close to their original shape; however, the engagement of rib 22*d* and annular projection 26 with the conductor terminated to contact 40, will result in some deformation of the seal of relaxation core 30. Thus it is seen that as the electrical contact 40 is inserted into a respective sealing unit 20, three major movements of the seal material occur, namely: the funnel-shaped section 22 will move towards a respective relaxation core 30, rib 22*d* will move towards annular recess 24, and annular projection 26 will flow towards box shaped recess 28. But it is important to note that stress will be relieved from rib 22*d* by interface angle β of recess zone 22*c* as well, and stress will be relieved from annular projection 26 by having the axial length of the relaxation core extend all the way to an area adjacent to the annular projection 26, especially in that the backwall 34 of relaxation core 30 will extend to a point which is substantially in alignment with a face of box shaped recess 28.

Thus, while a preferred embodiment of the invention has been disclosed, it is to be understood that the invention is not to be strictly limited to such embodiment but may be otherwise variously embodied and practiced within the scope of the appended claims. For example, it is contemplated that a funnel portion 22 can be formed on back face 18 instead of recess 28, with recess 24 taking a medial position in the seal 10, so that the contact 40 can be inserted from the front or back faces 16,18.

Accordingly, what is claimed is:

1. A seal for sealingly receiving and engaging an electrical conductor terminated to an electrical contact, comprising:

at least one sealing unit, said sealing unit includes a contact receiving aperture comprising a front section, said front section comprises face surfaces which are offset at respective offset angles relative to said contact receiving aperture, a portion of said face surfaces are adjacent to a recess zone, said recess zone is offset at an angle relative to said contact receiving aperture, and said recess zone offset angle is relatively larger than the offset angle of at least one of said face surfaces.

2. The seal of claim 1, wherein said front section comprises a generally funnel-shaped portion about said contact insertion aperture.

3. The seal of claim 1, wherein said contact receiving aperture comprises an annular recess disposed between a rib and a projection, each respectively formed of said seal.

4. The seal of claim 1, wherein said seal comprises at least one relaxation core adjacent to said sealing unit.

5. The seal of claim 4, wherein said relaxation core is axially aligned with said contact receiving aperture.

6. The seal of claim 5, wherein said relaxation core comprises an essentially void space of a given volumetric magnitude, and said void space becomes relatively smaller as said contact is inserted through said sealing unit.

7. The seal of claim 4, wherein said core comprises an elongate axis.

8. The seal of claim 7, wherein said sealing unit comprises a sealing rib disposed laterally of said core axis, and as said contact is inserted in said contact receiving aperture said sealing rib is pushed by said contact, which causes said core to narrow.

9. The seal of claim 1, wherein said recess zone comprises a shape which is centered over said contact aperture.

10. The seal of claim 1, wherein said recess zone is generally X-shaped.

11. A seal for sealingly receiving and engaging an electrical conductor terminated to an electrical contact, comprising:

(a) at least one sealing unit, said sealing unit includes a contact receiving aperture comprising a front section, said front section comprises face surfaces;

(b) said face surfaces comprise portions thereof which are adjacent to a recess zone, said face surfaces comprise respective bulge-like portions extending relative to the recess zone; and (c) said recess zone comprises a recessed boundary between the respective faces, said recess zone is operative to relieve stress in the seal as the electrical contact is inserted through said contact receiving aperture.

12. The seal of claim 11, wherein said seal comprises at least one relaxation core adjacent to said sealing unit.

13. The seal of claim 12, wherein said core comprises a core width, and as said terminal is inserted in said contact receiving aperture said core width is narrowed, thereby relieving stress in said seal.

14. The seal of claim 11, wherein said seal unit comprises corner sections, said recess zone extends between said faces adjacent said corner sections for stress-relievably receiving portions of said electrical contact as said electrical contact is inserted in said aperture.

15. A seal for sealingly receiving and engaging an electrical conductor terminated to an electrical contact, comprising:

(a) at least one sealing unit, said sealing unit includes a contact receiving aperture comprising a front section, said front section comprises face surfaces;

(b) a portion of said face surfaces are adjacent to a recess zone, said recess zone comprises a recessed boundary portion between said faces; and (c) said recess zone is operative to relieve stress in the seal as the electrical contact is inserted through said contact receiving aperture.

16. The seal of claim 15, wherein said sealing unit comprises a plurality of said faces and said recess zones comprising boundaries between said faces, said boundaries define a substantially X-shaped section generally centered over said contact receiving aperture.

17. The seal of claim 15, wherein said seal comprises at least one relaxation core adjacent to said sealing unit.

18. The seal of claim 17, wherein said core comprises a core width, and as said terminal is inserted in said contact receiving aperture said core width is narrowed, thereby relieving stress in said seal.

19. The seal of claim 15, wherein said seal unit comprises corner sections, said recess zone extends between said faces toward said corner sections for stress-releivably receiving portions of said electrical contact as said electrical contact is inserted in said aperture.

20. A seal formed of sealing material for sealingly receiving an electrical conductor terminated to an electrical contact, comprising:

(a) at least one sealing unit, said sealing unit includes a contact receiving aperture;

(b) said contact receiving aperture comprises sealing profiles for sealing engagement with said electrical conductor;

(c) said seal comprises a relaxation core formed in said seal adjacent to said sealing profiles and adjacent to said contact receiving aperture; and (d) as said electrical contact is inserted in said contact receiving aperture said electrical contact is engagable with said sealing profiles, causing said sealing material to flow, and said relaxation core is narrowed, said relaxation core being positioned adjacent to the sealing profiles in a position to relieve stress in the sealing material as the electrical contact is inserted through said contact receiving aperture.

21. The seal of claim 20, wherein one of said sealing profiles comprises a sealing profile rib section.

22. The seal of claim 20, wherein one of said sealing profiles comprises an annular projection sealing profile.

23. The seal of claim 20 comprising multiple sealing units and multiple relaxation cores.

24. An electrical connector seal for maintaining sealing integrity with a plurality of conductors attached to electrical contacts, the seal being fabricated from a sealing material that is stressed when deformed, the seal comprising;

multiple contact receiving apertures extending through the seal, each contact receiving aperture including at least one sealing profile rib on an inner peripheral surface, the contact receiving apertures and sealing profile ribs being sized relative to electrical contacts inserted therethrough such that sealing material surrounding the contact receiving apertures is subjected to stress as the electrical contacts are inserted therethrough; and multiple relaxation cores extending partially through the seal, each relaxation core being located beside a contact receiving aperture and beside sealing profile ribs in the contact receiving aperture in a position to relieve stresses induced in the seal as the sealing material moves outward during insertion of electrical contacts through contact receiving apertures to prevent damage to the sealing profile ribs during insertion of the electrical contacts through the contact receiving apertures.

* * * * *